US007052447B2

(12) United States Patent
Whittaker

(10) Patent No.: US 7,052,447 B2
(45) Date of Patent: May 30, 2006

(54) MAGNETIC CLIMBING DEVICE

(76) Inventor: Jeffrey B. Whittaker, 849 S. Claremont, Dearborn, MI (US) 48124

( * ) Notice: Subject to any disclaimer, the term of this patent is extended or adjusted under 35 U.S.C. 154(b) by 0 days.

(21) Appl. No.: 10/883,367

(22) Filed: Jul. 1, 2004

(65) Prior Publication Data

US 2005/0001118 A1 Jan. 6, 2005

Related U.S. Application Data

(60) Provisional application No. 60/485,303, filed on Jul. 3, 2003.

(51) Int. Cl.
*A63B 21/00* (2006.01)

(52) U.S. Cl. ..... 482/124; 2/115

(58) Field of Classification Search ..... 482/124, 482/121, 105, 148; 2/115, 113, 69, 271, 2/94; 600/75

See application file for complete search history.

(56) References Cited

U.S. PATENT DOCUMENTS 3,031,778 A 5/1962 Nicholson
5,192,155 A 3/1993 Meyer
5,306,222 A * 4/1994 Wilkinson ..... 482/124
5,807,019 A 9/1998 Meyer
5,950,239 A * 9/1999 Lopez ..... 2/115

* cited by examiner

*Primary Examiner*—Jerome W. Donnelly
(74) *Attorney, Agent, or Firm*—Knechtel, Demeur & Samlan

(57) ABSTRACT

A magnetic climbing device that consists of a hand unit and a leg unit. The hand unit is designed for attachment to the hands of a climber and provides finger sections, thumb section, and a palm section. Each section utilizes prepositioned magnets for attachment of the hand unit to a magnetic or ferromagnetic structure. Hand straps and fasteners are used to securely tighten the hand unit to each hand of the climber. The leg unit is designed for attachment to the legs of a climber and provides a planar member, a platform and base extension, straps and buckles. The planar member utilizes prepositioned magnets sequentially aligned along the length of the planar member for attachment of the leg unit to a magnetic or ferromagnetic structure. A sleeve is used to cover the planar member and base extension to protect the leg of the climber and provide additional friction, if necessary.

13 Claims, 3 Drawing Sheets

MAGNETIC CLIMBING DEVICE

This application claims the benefit of U.S. Provisional Ser. No. 60/485,303 filed on Jul. 3, 2003.

FIELD OF THE INVENTION

The present invention relates to climbing devices and, more particularly, to a unique climbing device that utilizes magnetic substances for scaling ferromagnetic structures.

DESCRIPTION OF THE PRIOR ART

Climbing is an activity that is enjoyed by persons of all ages for recreation and/or the varying challenges that it presents. A novice climber may prefer climbing structures that are designed or provided with hand holds, foot holds, or other extensions for assisting them in climbing that structure and reaching their climbing goals. For the more experienced climber, removing all of the extensions and climbing a flat surfaced structure may be a better challenge and more suited to their ability. In this type of situation, the flat surfaced structure is often made of a ferromagnetic type material and the climber utilizes a magnetic type attachment or other climbing device to scale or climb the structure.

Examples of a magnetic attachment or climbing device are U.S. Pat. No. 5,807,019 and U.S. Pat. No. 5,192,155 to Meyer and entitled "Magnetic Gripper Device." These patents disclose devices that provide a frame having cam surfaces which are rotatably attached to a magnet for adhering the device to a ferromagnetic surface. An ear is also provided which extends from the magnet to engage the ferromagnetic surface at a location spaced from the cam surfaces. To disengage the device from the ferromagnetic surface, the ear is first disengaged from the ferromagnetic surface, after which, the remainder of the magnet from the device can be removed from the surface.

Likewise, U.S. Pat. No. 3,031,778 to Nicholson entitled "Magnetic Shoe Attachment" discloses a shoe attachment which uses electromagnets embedded in the sole of the shoe for attachment to metal surfaces. The electromagnets are energized by a pair of batteries and the batteries are regulated by a potentiometer.

Each of the above devices while useful, provide several inherent problems to potential climbers. First, when climbing, climbers strive for agility and good climbing speed. Yet, the above devices provide unnecessary mechanical complexity that limits climbing speed and agility and thereby reduces the effectiveness of the climber. Second, the devices appear heavy and bulky making them unsuitable for use in many locations, especially a vertical structure. Third, in scaling vertical ferromagnetic structures, high magnetic forces are required to overcome the force of gravity and hold a climber on the surface. This is especially important for a climber in the inverted position or suspended from the ceiling of the structure. The above devices, however, are not designed for such extreme uses; but rather, designed for more horizontal type surfaces such as storage tanks, steel frames, and the like. Fourth, even if these devices accommodated such extreme uses, the devices are impractical and/or ill suited for such use by the climber. For example, given the extremely high magnetic field strength needed to climb vertical ferromagnetic surfaces, electromagnets would be impractical due to the high current strength needed to maintain the magnetic field strength and the added weight the electric power source would add to the climber. Additionally, the embedded magnets in the sole of a shoe places the magnets in an unfavorable orientation for the climber to physically climb a vertical ferromagnetic surface.

Thus, there is a need and there has never been disclosed Applicant's unique climbing device providing high magnetic forces for scaling ferrous, ferromagnetic, and/or magnetic structures.

OBJECTS OF THE INVENTION

It is the primary object of the present invention to provide a climbing device that provides high magnetic forces for scaling or climbing magnetic or ferromagnetic structures. A related object of the present invention is to provide a device that incorporates both hand and leg units for scaling or climbing the magnetic or ferromagnetic structures.

Another object of the present invention is to provide a climbing device that is designed to facilitate the high magnetic forces required for extreme uses. A related object of the present invention is to provide a climbing device that systematically enables the climber to manually remove either or both of the hand or leg units, as desired, while climbing.

Another related object of the present invention is to provide a climbing device that facilitates climbing speed, agility, and/or movement over the surface of magnetic or ferromagnetic structure.

Another object of the invention is to provide a climbing device that is capable of being used by climbers of all levels and ability.

Still another object of the invention is to provide a device that is safe and easy to use.

Other objects of the present invention will become more apparent to persons having ordinary skill in the art to which the present invention pertains from the following description taken in conjunction with the accompanying drawings.

SUMMARY OF THE INVENTION

The present invention is a magnetic climbing device that consists of a hand unit and a leg unit. The hand unit is designed for attachment to the hands of a climber and provides finger sections, thumb section, and a palm section. Each section utilizes prepositioned magnets for attachment of the hand unit to a ferrous, ferromagnetic, and/or magnetic structure. Hand straps and fasteners are used to securely tighten the hand unit to each hand of the climber. The leg unit is designed for attachment to the legs of a climber and provides a flexible planar member, a platform and base extension, straps and buckles. The planar member utilizes prepositioned magnets sequentially aligned along the length of the planar member for attachment of the leg unit to the structure. A sleeve is used to cover the planar member and base extension to protect the leg of the climber and provide additional friction, if necessary.

BRIEF DESCRIPTION OF THE DRAWINGS

The Description of the Preferred Embodiment will be better understood with reference to the following figures.

DETAILED DESCRIPTION OF THE PREFERRED EMBODIMENT

Figure 1:
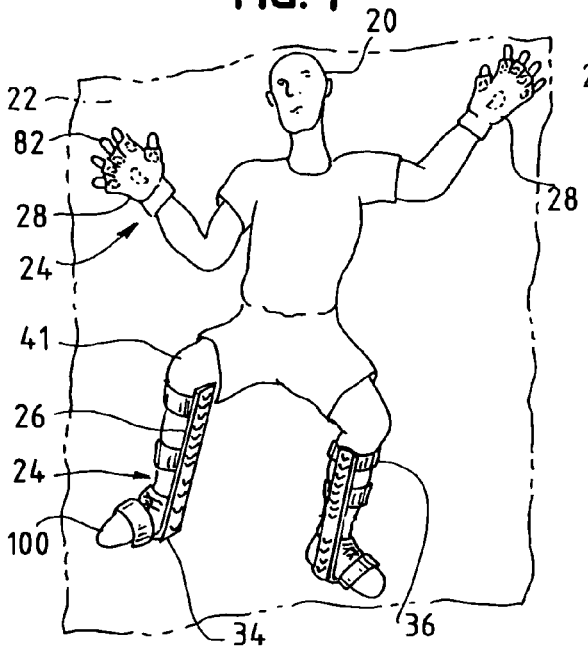
FIG. 1 is a front view of a climber using Applicant's climbing device to scale or climb a magnetic or ferromagnetic structure.
Figure 2:
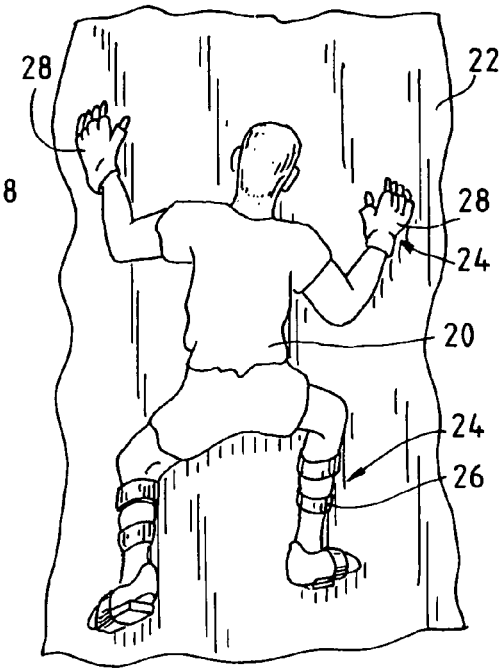
FIG. 2 is a back view of a climber using Applicant's climbing device to scale or climb a magnetic or ferromagnetic structure.

Turning first to FIGS. 1 and 2, there is illustrated a climber 20 scaling or climbing a ferrous, ferromagnetic, and/or magnetic structure 22 (i.e., structure) using a climbing device 24. The climbing device comprises a leg unit 26 and a hand unit 28. In the preferred embodiment, the structure 22 may be any type of structure such as steel made from substances including but not limited to iron, nickel, cobalt, or other alloys that exhibit high magnetic permeability. The structure 22 should also provide a sufficient thickness to engage the climbing device 24 and support the weight of the climber 20.

Figure 3:
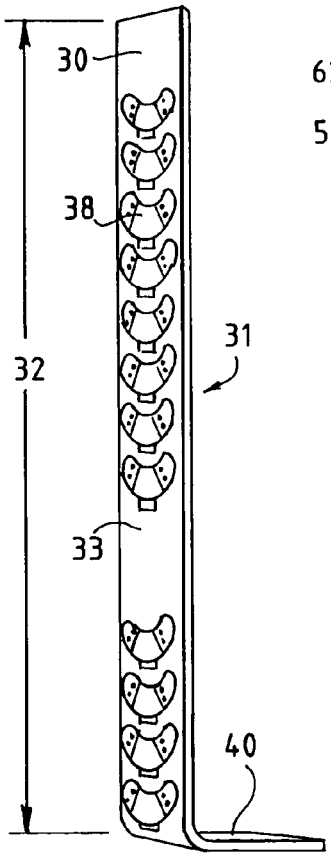
FIG. 3 is a front perspective view of the planar member and magnets used in the leg unit of the climbing device.
Figure 4:
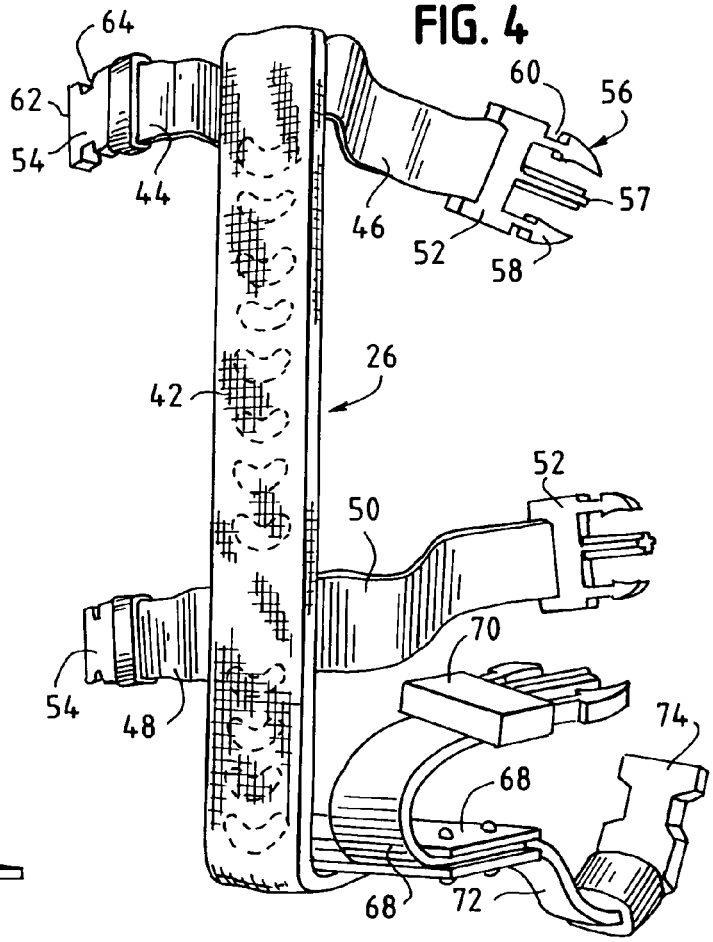
FIG. 4 is a front perspective view of the leg unit of the climbing device and, in particular, illustrating the means for attaching the leg unit to a climber.

The leg unit 26 is more clearly illustrated in FIGS. 3 and 4. The leg unit 26 comprises an elongated planar member 30 having a interior surface 31 and an exterior surface 33. In the preferred embodiment, the planar member 30 has a length 32 that approximates the length of a climber's leg as measured from the heel of a foot 34 to the base of a knee 36 (FIG. 1). As climbers range in height from small children to tall adults, the planar member 30 is likewise adjusted to accommodate the size of the climber 20. The planar member 30 is preferably made from a durable, flexible, and lightweight material such as aluminum. Alternatively, the planar member 30 may be made of any type of material including but not limited to fiberglass, carbon fiber, graphite, wood, or any other type of material provided that the planar member 30 has a restitution coefficient sufficient to provide flexibility to accommodate engagement and removal from the structure 22 and return the planar member 30 to its original position after being used.

Located on the exterior surface 33 of the planar member 30 are magnets 38. In the preferred embodiment, the magnets 38 are positioned adjacent to one another and extend substantially along the entire length 32 of the planar member 30. The number of magnets 38 used is dependent upon the length of the leg and the size and weight of the climber 20. Preferably, each individual magnet 38 is made from an alloy of neodymium, iron and boron, or other suitably strong magnetic material. In the preferred embodiment, all the magnets 38 coact to provide sufficient magnetic strength to hold a leg 41 of the climber 20 to the magnetic or ferromagnetic structure 22.

A base extension 40 is located at one end of the planar member 30. The base extension 40 extends perpendicular from the interior surface 31 of the planar member 30. Preferably, the base extension 40 is integrally molded to the planar member 30 and made of the same material as the planar member 30. Alternatively, the base extension 40 may be made of any other material provided that the base extension 40 and the material are sufficient to satisfy its intended purpose as described in further detail below.

A sleeve 42 (FIG. 4) is used to cover the entire planar member 30, all the magnets 38, and the base extension 40. In the preferred embodiment, the sleeve 42 is made of a durable, high friction material such as rubber. Alternatively, the sleeve 42 may be a coating using a liquid rubber or a liquid polymer. This coating is to be formed by a solvent based liquid rubber polymer applied directly to the planar member 30, magnets 38, and/or base extension 40.

Attached to the sleeve 42, using brackets 43 (FIG. 6), are straps 44, 46, 48, and 50. Straps 46 and 50 are affixed, at one end, to the side of the sleeve 42 and, at the other end, have a key clasp 52. Straps 44 and 48 are affixed, at one end, to the opposite side of the sleeve 42 from straps 46 and 50, respectively, and, at the other end, have a locking sleeve 54. In the preferred embodiment, straps 44 and 46 are located at the base of the knee 36 and straps 48 and 50 are located in close proximity to the base extension 40. Straps 44, 46, 48, and 50 are preferably made of a high-tensile strength material such as nylon or cotton. Alternatively, the straps 44, 46, 48, and 50 may be made of any other type of material provided the straps are made of a material sufficient to satisfy its intended purpose as described in further detail below.

Figure 6:
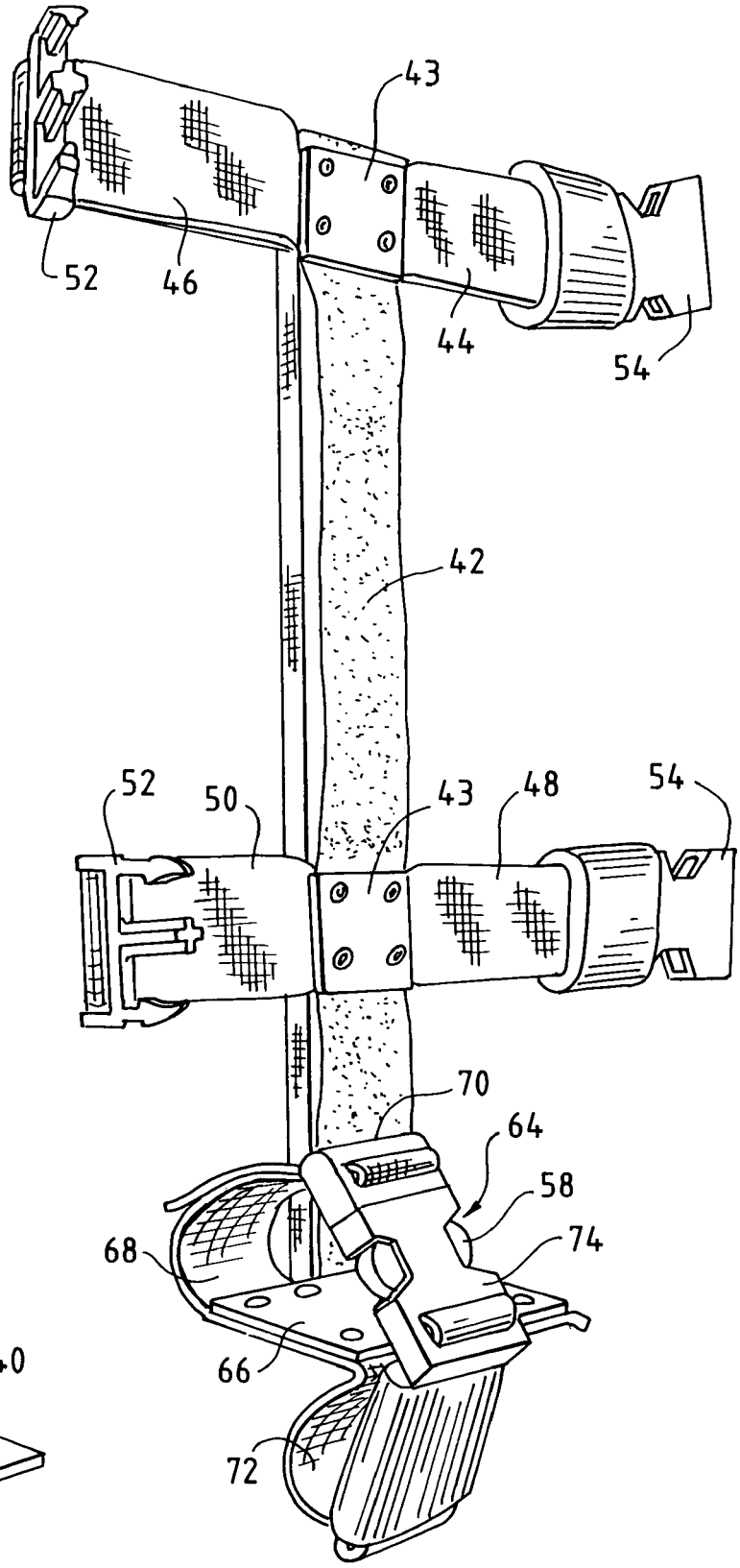
FIG. 6 is a back perspective view of the leg unit of the climbing device and, in particular, illustrating the means for attaching the leg unit to the climber.

The key clasp 52 has flexible finger projections 56 and a center section 57. The finger projections each have tip portions 58 and a cutaway 60. The locking sleeve 54 has a front opening 62 and side openings 64. In combination, the key clasp 52 and the locking sleeve 54 coact as a buckle. The key clasp 52 is inserted into the front opening 62 of the locking sleeve 54. As the key clasp 52 enters the front opening 62, the finger projections 56 are forced by the interior side of the locking sleeve 54 within the front opening 62 to bend inwardly toward the center section 57. The finger projections 56 of the key clasp 52 continue moving within the front opening 62 of the locking sleeve 54 until the tip portions 58 reach the side openings 64 in the locking sleeve 54. Once the top portions 58 reach the side openings 64, the tip portions 58 return to their original orientation and, as permitted by the cutaway 60, protrude outwardly through the side openings 64 in the locking sleeve 54 thereby locking the key clasp 52 to the locking sleeve 54. The resulting buckle formed by the key clasp 52 and locking sleeve 54 is illustrated in FIG. 6. In order to release the key clasp 52 from the locking sleeve 54, the tip portions 58 must be depressed back through the side openings 64 and into the locking sleeve 54, after which, the key clasp 52 may then be pulled away from the front opening 62 until the key clasp 52 is removed from the locking sleeve 54 and thereby released from one another.

A platform 66 is situated above the base extension 40. The platform 66 is a flat surface that is used to support the foot of the climber 20. The platform 66 provides a strap 68 having a key clasp 70 and a corresponding strap 72 and locking sleeve 74 that combine to act as a buckle in the same manner as that previously described herein and depicted in FIG. 6.

Figure 5:
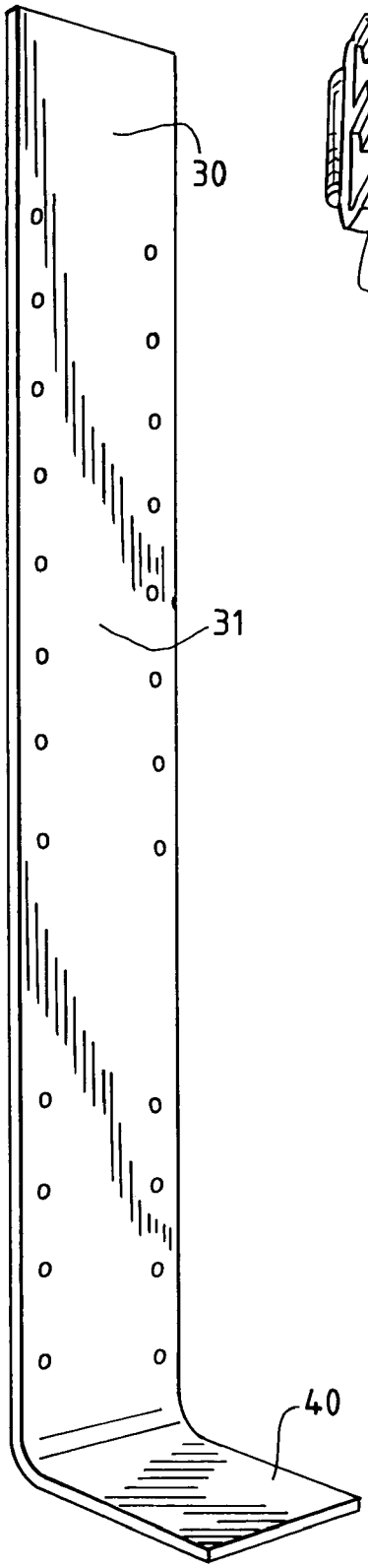
FIG. 5 is a back perspective view of the planar member used in the leg unit of the climbing device.
Figure 9:
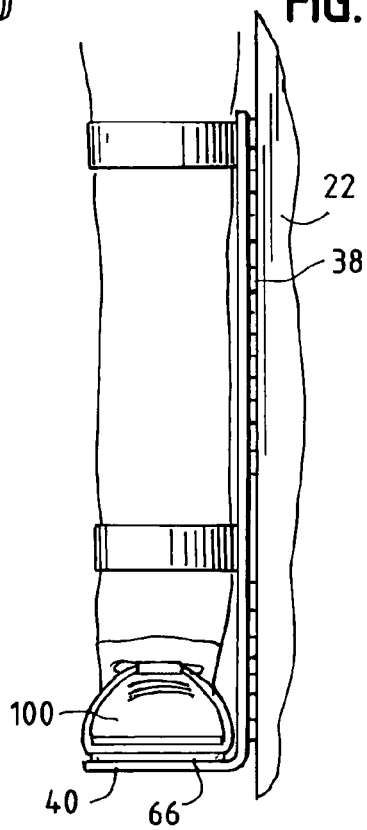
FIG. 9 is a side view of the leg unit of the climbing device as attached to leg of a climber and the magnetic or ferromagnetic structure.

As illustrated in FIG. 5, the interior surface 31 of the planar member 30 is a flat surface and designed, along with the sleeve 42 (FIG. 6), to be placed flush and comfortably against the leg (FIGS. 1 and 9).

Figure 7:
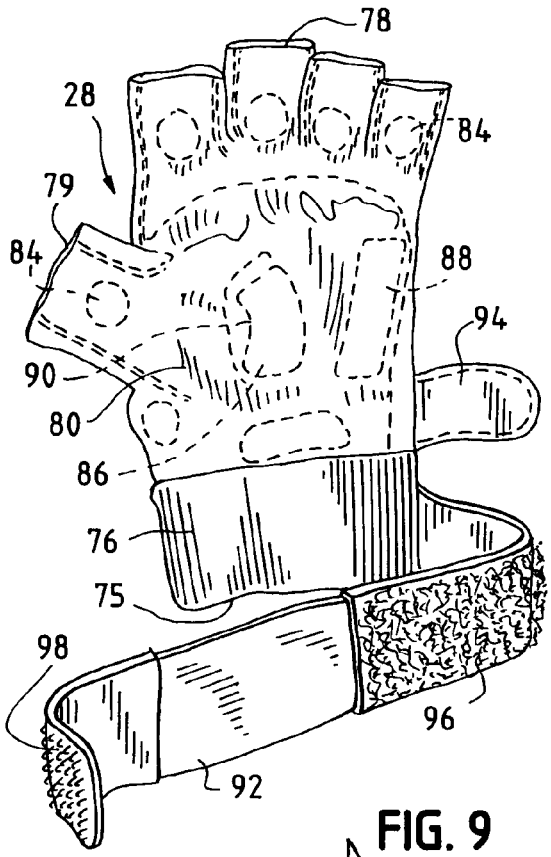
FIG. 7 is a front view of the hand unit of the climbing device and, in particular, illustrating the magnets and means for attaching the hand unit to the climber.

Turning to FIG. 7, the hand unit 28 is more clearly illustrated. The hand unit 28 has a wrist section 76, finger sections 78, thumb section 79, and a palm section 80 each coacting to receive a hand 82 (FIG. 1) of a climber 20 therein. The wrist section 76 provides an opening 75 to accommodate entry of the hand of the climber 20. The finger sections 78 total four and are designed to individually receive each finger of a climber 20. Likewise, the thumb section 79 is designed to receive the thumb of a climber 20. Located within each finger section 78 and thumb section 79 are magnets 84. The magnets 84 are preferably positioned in the center of the finger section 78 and thumb section 79 adjacent to the palm section 80 of the hand. In the preferred embodiment, the magnets 84 are made of the same type of material as magnets 38.

Located within the palm section 80 are magnets 86 and 88. Magnet 86, in a non-limiting example, provides an arc 90 that is ergonomically designed to be placed within the palm section 80 at the base of the thumb section 79. Magnet 88 is elongated and spans substantially the length between the finger sections 78 and wrist section 76. Magnets 86 and 88 are also made of the same type of material as magnets 38. Alternatively, magnet 86 and magnet 88 may be any shape provided both magnets do not exceed the size of the palm section 80. In the preferred embodiment, magnets 84, magnet 86, and magnet 88 coact to provide sufficient magnetic strength to hold the hand 82 of the climber 20 to the magnetic or ferromagnetic structure 22.

Figure 8:
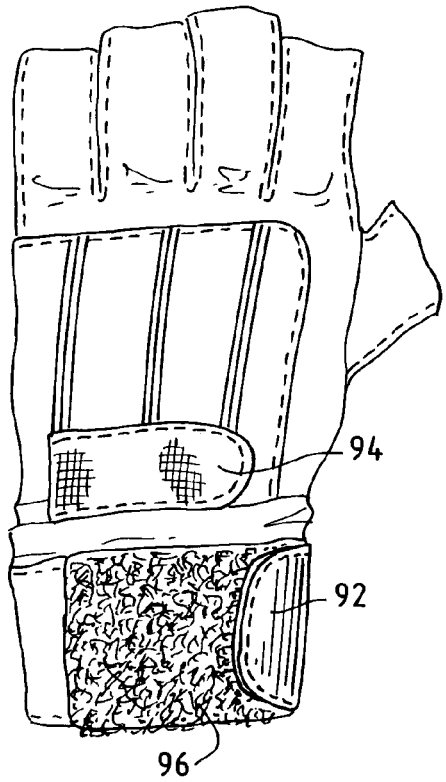
FIG. 8 is a back view of the hand unit of the climbing device and, in particular, illustrating the hand unit as it would appear attached to the climber.

The hand unit 28 is provided with hand straps 92 and 94 to securely tighten the hand unit 28 to the hand 82 of the climber 20. Strap 92 is an elongated member having fasteners 96 and 98 located on opposite sides of the strap 92 from one another. Fastener 96 and 98 each consist of a strip of nylon having a surface of minute hooks that enable it to be fastened to a corresponding strip nylon having a like surface. In the preferred embodiment, fasteners 96 and 98 are made of Velcro® which is a federally registered trademark owned by Velcro Industries located in the Netherlands. In use, strap 92 is wrapped around the exterior of the wrist section 76 thereby securely tightening the wrist section 76 around the wrist of the climber 20. Once the strap 92 is tightened to its desired pressure, fastener 96 of strap 92 is fastened to fastener 98 for holding the strap 92 in its desired position. To release the strap 92, fastener 98 is merely pulled away from fastener 96 to separate the surfaces thereby releasing the pressure on the wrist section 76. Likewise, strap 94 is secured to the back side of the hand unit 28 as illustrated in FIG. 8.

To use Applicant's climbing device, the hand unit 28 is affixed to each hand 82 of the climber 20 and the leg unit 26 is affixed to each leg 41 of the climber 20. With respect to the leg unit 26, the straps 44 and 46 wrap around the base of the knee 36 of the leg 41 of the climber 20 and are secured by the resulting buckle as formed by the key clasp 58 and locking sleeve 54 (i.e., first securing means). Likewise, straps 48 and 50, in close proximity above the foot 100, wrap around the leg 41 of the climber 20 and are secured by the resulting buckle as formed by the key clasp 58 and locking sleeve 54 (i.e., second securing means). Lastly, straps 68 and 72 wrap around the foot 100 of the climber 20 and are secured by the resulting buckle as formed by the key clasp 70 and locking sleeve 74 (i.e., third securing means). This third securing means securely tightens the foot 100 of the climber 20 to the platform 66 of the leg unit 26. The combination of all three securing means enables the leg unit 26 to be securely tightened to the leg 41 of the climber 20.

With the climbing device 24 secured, the climber 20 is ready to begin climbing. Upon approaching the magnetic or ferromagnetic structure 22, the hands 82 are raised in the air with the first hand engaging the structure 22 using the hand unit 28. The hand unit 28 utilizes the magnets 84, magnet 86, and magnet 88 to attract the magnetic structure 22 and retaining the first hand to the structure 22. The second hand likewise engages the structure 22. Once both hands are engaged, the first leg of the climber 20 is lifted for engaging the structure 22. With the foot 100 pointing slightly outward and with the exterior side 33 of the leg unit facing the structure 22, the magnets 38 attract the magnetic structure 22 for retaining the first leg to the structure 22 as illustrated in FIG. 9. With the first hand, the second hand, and the first leg attached to the structure 22, the weight of the climber 20 can be supported thereby enabling the climber 20 to lift the second leg and likewise attach it to the structure 22. When all the limbs of the climber 20 are attached to the structure 22, the climber 20 has a spider-like appearance on the structure 22 as illustrated in FIGS. 1 and 2. In the preferred embodiment, all the magnets 38 in the leg unit 26 and the magnets 84, 86, and 88 combine to provide sufficient magnetic strength to support the weight of the climber 20 on the magnetic or ferromagnetic structure 22.

Figure 10:
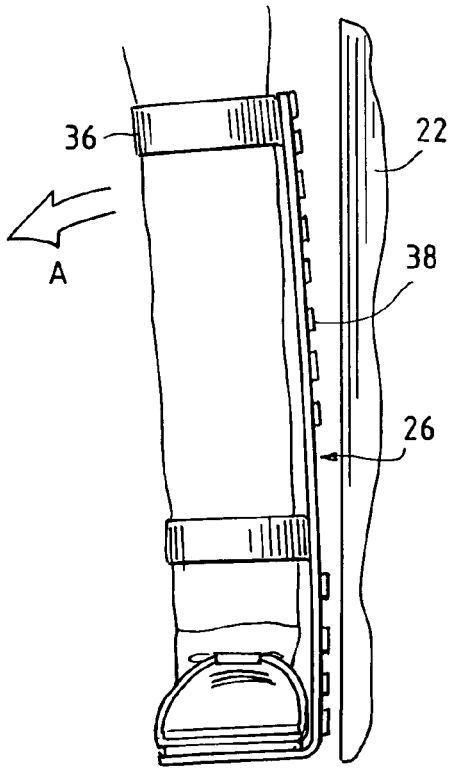
FIG. 10 is a side view of the leg unit of the climbing device being systematically removed from the magnetic or ferromagnetic structure.

To continue toward the top of the structure 22, the climber 20 peels away the palm section 80, the thumb section 79, and then each finger section 78 for completely removing the hand unit 28 of the first hand from the structure 22. After the first hand is completely removed from the structure 22, the climber 20 lifts and places the first hand at a next higher position. The second hand follows in the same manner. To remove the first leg to place it in the next higher position, the climber 20, as illustrated in FIG. 10, begins by pulling the base of the knee 36 in the direction A away from the structure 22. When the first leg is pulled, the magnets 38 located at the base of the knee 36 is peeled or removed from the structure 22. As the first leg is continued to be pulled in the direction A away from the structure 22, the next lower adjacent magnet 38 is likewise peeled or removed from the structure 22, and then the next lower adjacent magnet 38, and then the next lower adjacent magnet 38 until all of the magnets 38 have been sequentially peeled away or removed from the structure 22 and completely releasing the leg unit 26 from the structure 22. Once removed, the climber 20 may then reposition the first leg. The second leg follows in the same manner. This process is repeated until the climber 22 reaches the top of the structure 22.

Thus, there has been provided a unique magnetic climbing device that utilizes hand and leg units of prepositioned ferromagnetic substances for scaling magnetic structures. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A climbing device intended to be worn by a climber and adapted for scaling a structure to which magnets are attracted, comprising in combination:

a hand unit formed of a sufficient size to be worn on a hand of the climber, the hand unit having a wrist section and a palm section, the wrist section having an open end to accommodate entry of the hand of the climber, the palm section having finger sections and a thumb section corresponding to the fingers and thumb of the hand of the climber;

magnets attached to the hand unit;

means for securing the hand unit to the hand of the climber;

a leg unit formed of a sufficient size to be worn on a leg of the climber, the leg unit having a planar member, the planar member having an interior surface and an exterior surface;

a plurality of magnets attached to the exterior surface of the planar member;

means for attaching the leg unit to the leg of the climber;

a foot platform attached to the leg unit for supporting a foot of the climber; and the magnets of the hand unit and the plurality of the leg unit coacting to engage the structure with a magnetic force sufficient to support the weight of the climber when scaling the structure, the magnets of the hand unit and the plurality of magnets of the leg unit being independently released from the structure and reattached at different locations for enabling the climber to traverse the structure.

2. The climbing device of claim 1 wherein the magnets are attached to the palm section, the finger sections, and the thumb section of the hand unit.

3. The climbing device of claim 1 wherein the means for securing the hand unit to the hand of the climber consists of a hand strap having a top surface and a bottom surface, the hand strap wrapping about a wrist of the climber.

4. The climbing device of claim 3 and further comprising a first fastener attached to a portion of the top surface of the hand strap and a second fastener attached to a portion of the bottom surface of the hand strap, the first fastener and the second fastener coacting for securing the top surface to the bottom surface thereby securing the hand unit to the hand of the climber.

5. The climbing device of claim 3 wherein the hand strap is attached to the wrist section of the hand unit.

6. The climbing device of claim 1 wherein the plurality of magnets are sequentially aligned along the exterior surface of the planar member.

7. The climbing device of claim 6 wherein the plurality of magnets are identical to each other.

8. The climbing device of claim 1 wherein the magnets in the hand unit and the plurality of magnets in the leg unit provide a magnetic force of sufficient strength to support the weight of the climber scaling the structure.

9. The climbing device of claim 1 wherein the means for attaching the leg unit to the leg of the climber consists of leg straps and a foot strap, each strap having a center and opposed ends.

10. The climbing device of claim 9 wherein the center of the leg straps and foot strap are attached to the leg unit and the opposed ends of the leg straps having locking means thereon for locking the opposed end to each other and forming an enclosure around the leg and foot of the climber.

11. The climbing device of claim 10 wherein the locking means comprises a key clasp on one opposed end and a locking sleeve on the other opposed end, the key clasp and the locking sleeve combining for creating a buckle.

12. A climbing device intended to be worn by a climber and adapted for scaling a structure to which magnets are attracted, comprising in combination:

a hand unit formed of a sufficient size to be worn on a hand of the climber, the hand unit having a wrist section and a palm section, the wrist section having an open end to accommodate entry of the hand of the climber, the palm section having finger sections and a thumb section corresponding to the fingers and thumb of the hand of the climber;

magnets attached to the hand unit;

means for securing the hand unit to the hand of the climber;

a leg unit formed of a sufficient size to be worn on a leg of the climber, the leg unit having a planar member, the planar member having an interior surface and an exterior surface;

a plurality of magnets attached to the exterior surface of the planar member;

means for attaching the leg unit to the leg of the climber; and a sleeve for covering the planar member and plurality of magnets.

13. The climbing device of claim 1 wherein the planar member has a top and a bottom and the plurality of magnets are sequentially arranged in a row from the top to the bottom of the planar member.

* * * * *

UNITED STATES PATENT AND TRADEMARK OFFICE

CERTIFICATE OF CORRECTION

PATENT NO. : 7,052,447 B2
APPLICATION NO. : 10/883367
DATED : May 30, 2006
INVENTOR(S) : Whittaker, Jeffrey B.

It is certified that error appears in the above-identified patent and that said Letters Patent is hereby corrected as shown below:

In column 7, line 16, after “plurality” add --of magnets--.

Signed and Sealed this

Twenty-second Day of August, 2006

JON W. DUDAS
*Director of the United States Patent and Trademark Office*